US011324360B2

(12) United States Patent
Soussan

(10) Patent No.: US 11,324,360 B2
(45) Date of Patent: May 10, 2022

(54) ASSEMBLY FOR WASHING VESSEL AND CHAMBER

(71) Applicant: Nahman Ariel Soussan, Jerusalem (IL)

(72) Inventor: Nahman Ariel Soussan, Jerusalem (IL)

( * ) Notice: Subject to any disclaimer, the term of this patent is extended or adjusted under 35 U.S.C. 154(b) by 0 days.

(21) Appl. No.: 16/986,546

(22) Filed: Aug. 6, 2020

(65) Prior Publication Data

US 2022/0039607 A1 Feb. 10, 2022

(51) Int. Cl.
*A47K 1/02* (2006.01)
*E03C 1/04* (2006.01)
*A47K 10/48* (2006.01)

(52) U.S. Cl.
CPC ..... *A47K 1/02* (2013.01); *A47K 10/48* (2013.01); *E03C 1/04* (2013.01)

(58) Field of Classification Search
CPC . A47K 1/12; A47K 1/02; A47K 10/48; E03D 1/20; E03C 2201/90
See application file for complete search history.

(56) References Cited

U.S. PATENT DOCUMENTS 468,725 A * 2/1892 Malcolm ..... E03D 1/20 4/365
509,295 A * 11/1893 Brown ..... A47K 1/02 4/625
2,212,943 A * 8/1940 Kolarik ..... E03D 1/20 4/325
2,542,338 A * 2/1951 Laufenberg ..... E03D 1/01 4/251.2
5,301,376 A * 4/1994 Herbert ..... A47K 1/02 220/379
5,522,411 A * 6/1996 Johnson ..... A47K 5/1202 134/104.2
6,161,227 A * 12/2000 Bargenquast ..... A47K 1/04 134/58 R
2010/0065767 A1* 3/2010 Pubben ..... G05G 1/52 251/231
2011/0289668 A1* 12/2011 Neves ..... E03D 1/14 4/324

* cited by examiner

*Primary Examiner* — Janie M Loeppke
(74) *Attorney, Agent, or Firm* — Mark M. Friedman

(57) ABSTRACT

An apparatus for washing hands may have a chamber having a water outlet and a vessel at least partly in the chamber. An axle extending into the chamber is configured to attach to the vessel such that the vessel rotates relative to the axle to pour water out of the vessel and into the chamber. The vessel has a valve mechanism configured to close a valve and thereby block further entry of water into the vessel when a water level in the vessel reaches a certain level, for example when it exerts an upward force on a float. A water inlet delivers water to or into the vessel through a vessel wall to the valve and is configured to allow a constant flow of water into the vessel until the water inlet is closed by the valve mechanism. In some embodiments without a chamber, water drains external to the apparatus.

19 Claims, 10 Drawing Sheets

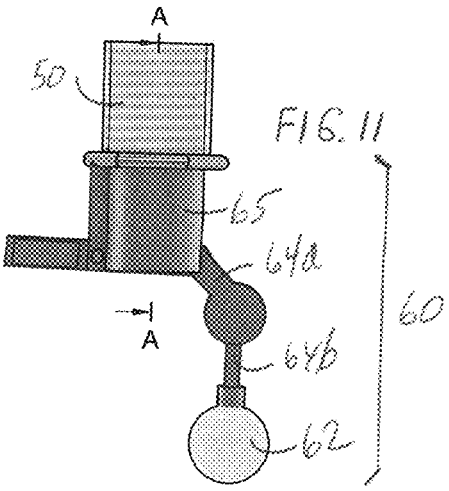
FIG. 11
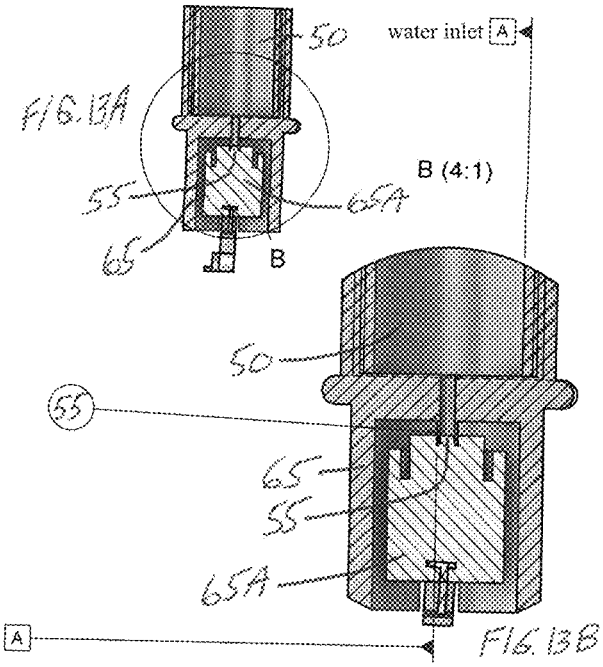
FIG. 13A
FIG. 13B
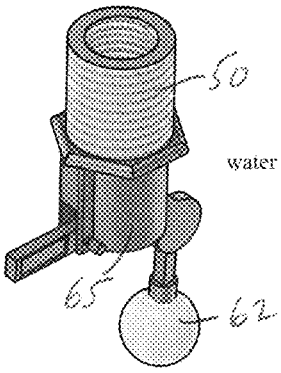
FIG. 12

ASSEMBLY FOR WASHING VESSEL AND CHAMBER

FIELD AND BACKGROUND OF THE INVENTION

The invention, in certain embodiments, relates to apparatuses and methods for washing hands, and more particularly, to apparatuses and methods that allow many people washing hands efficiently.

For hygienic reasons and/or for reasons of religious ritual, people of all ages need to wash their hands, for example before partaking of certain food and before prayers. For example, before a life cycle event such as a wedding, where food is served to large numbers of people, religious people are required to wash their hands and this leads to a need for large numbers of people to wash their hands all at around the same time. This causes delay and is inconvenient.

SUMMARY OF THE EMBODIMENTS

In one embodiment, an apparatus for washing hands comprises a chamber configured to hold water for washing hands, the chamber having a water outlet to drain the water out of the chamber; a vessel for holding and pouring water, at least a portion of the vessel situated in the chamber; an axle extending into the chamber and configured to attach to the vessel such that the vessel is configured to rotate relative to the axle in order to pour water out of the vessel and into the chamber; a water inlet configured to deliver water to or into the vessel, the vessel having a valve mechanism for regulating a flow of water into the vessel such that whenever a water level in the vessel reaches a certain level, the valve mechanism automatically ensures that water stops flowing into vessel, the valve mechanism including a valve connected to the water inlet, wherein the water inlet is configured to allow a constant flow of water into the vessel until the valve is closed by the valve mechanism.

In certain embodiments, the valve mechanism includes a float situated in the vessel and the valve mechanism is configured to close the valve when water in the vessel exerts an upward force on the float.

In some embodiments, the water inlet runs through the axle.

In some embodiments, at least one wall of the chamber has two apertures, each of the apertures configured to allow an individual to insert a hand into the chamber.

In some embodiments, the apparatus further comprises a vessel handle configured to extend outside the chamber for rotating the vessel on the axle from outside the chamber.

In some embodiments, the chamber has a rotatable ceiling and is configured to attach to a wall of a room such that the ceiling cannot be rotated as long as the chamber is attached to the wall of the room.

In some embodiments, the apparatus for comprises a clamp assembly for attaching the chamber to a desk.

In some embodiments, the apparatus further comprises an automated hand drying mechanism situated in or alongside the chamber. In some embodiments, the automated hand drying mechanism includes a fan configured to blow air on a user's hands when the user's hands are situated at least partly in the apertures.

In some embodiments, the apparatus further comprises a leg-activated actuator for rotating the vessel.

In some embodiments, the apparatus further comprises a first bearing assembly connecting the vessel to the axle, the first bearing assembly configured to allow rotation of the vessel relative to the axle with one particular degree of freedom of movement and a second bearing assembly configured to allow rotation of the vessel relative to the axle with a second degree of freedom.

In some embodiments, the chamber includes a ledge jutting out of a front wall of the chamber.

In another embodiment, an apparatus for washing hands comprises a vessel for holding and pouring water; an axle configured to attach to the vessel such that the vessel is configured to rotate relative to the axle in order to pour water out of the vessel and into a drainage area external to the apparatus; a water inlet configured to deliver water to or into the vessel, the vessel having a valve mechanism for regulating a flow of water into the vessel such that whenever a water level in the vessel reaches a certain level, the valve mechanism automatically ensures that water stops flowing into vessel, the valve mechanism including a valve connected to the water inlet, wherein the water inlet is configured to allow a constant flow of water into the vessel until the water inlet is closed by the valve mechanism.

In some embodiments, the valve mechanism includes a float situated in the vessel and the valve mechanism is configured to close the valve when water in the vessel exerts an upward force on the float.

In some embodiments, the water inlet runs through the axle.

In some embodiments, the apparatus further comprises a vessel handle configured to rotate the vessel relative to the axle.

In some embodiments, the apparatus further comprises a clamp assembly for attaching the apparatus to a desk.

In some embodiments, the apparatus further comprises a leg-activated actuator for rotating the vessel.

In some embodiments, the apparatus further comprises a first bearing assembly connecting the vessel to the axle, the first bearing assembly configured to allow rotation of the vessel relative to the axle with one particular degree of freedom of movement and a second bearing assembly configured to allow rotation of the vessel relative to the axle with a second degree of freedom.

These and other features, aspects and advantages of certain embodiments will become better understood with reference to the following drawings, descriptions and claims.

BRIEF DESCRIPTION OF THE DRAWINGS

Various embodiments are herein described, by way of example only, with reference to the accompanying drawings, wherein:

FIG. 6A is a partial cross-sectional view of a chamber taken from the rear and side and showing a float mechanism inside a vessel used in an apparatus, in accordance with one embodiment;

FIG. 11 is a side view of a valve mechanism and part of a water inlet used in an apparatus, in accordance with one embodiment;

FIG. 12 is a perspective view of a valve mechanism and part of a water inlet used in an apparatus, in accordance with one embodiment;

FIG. 13A is a sectional view of FIG. 11 showing part of the valve mechanism and part of the water inlet used in an apparatus, in accordance with one embodiment;

FIG. 13B is an enlarged sectional view of FIG. 11 showing part of the valve mechanism and part of the water inlet used in an apparatus, in accordance with one embodiment;

DETAILED DESCRIPTION OF THE EMBODIMENTS

Figure 1:
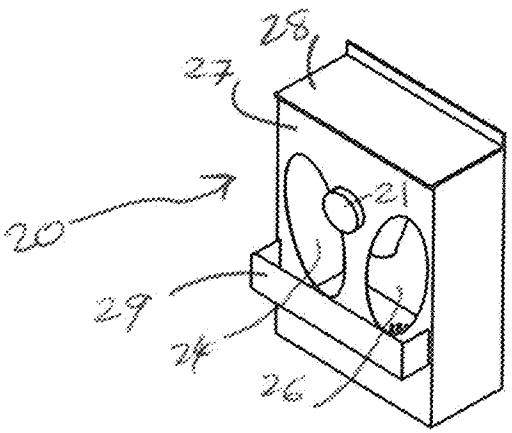
FIG. 1 is a view from the front and side of a chamber used in a washing apparatus, in accordance with one embodiment.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain embodiments of the invention generally provide a convenient and practical method and apparatus for a washing station usable by many people. Washing by pouring water from a washing vessel (as opposed to putting one's hands under a faucet) is mandatory according to certain religious rituals. Each person using the washing station need not turn on the water or turn off the water and need not move the washing vessel into position for use. This saves time, particularly when the number of people using the washing station is large. In accordance with certain embodiments, the user need only tilt the vessel (directly or indirectly such as by using an actuator). In some embodiments, even a long line of people will be able to wash hands one after the other without the tedious long wait of positioning the vessel and filling and refilling the vessel. In certain embodiments, the apparatus described herein also avoids the mess of wetness because in certain embodiments it directs the used water into a drainage floor of the chamber and because in some embodiments of the chamber the chamber includes a ledge configured to capture any water falling or spraying during the procedure of washing the hands. The apparatus is suited in certain embodiments for the handicapped, for parents helping children wash. It also can be actuated by one's leg, in some embodiments.

In certain embodiments, the apparatus for washing hands comprises a chamber configured to hold water used for washing hands. In other embodiments, there is no chamber and the apparatus may adjoin a sink or other water drainage area. If apparatus includes a chamber, the chamber has a water outlet to drain the water out of the chamber. The apparatus includes a vessel for holding and pouring water. The washing vessel is situated within the chamber although that is not a limitation (there can be no ceiling on the chamber and less than the entire vessel can be within the chamber with the rest sticking out in certain embodiments). In certain embodiments at least a portion of the vessel is situated in the chamber.

An axle extends into the chamber in some embodiments and the axle is configured to attach to the vessel or to a bearing assembly connected to the vessel such that the vessel can rotate relative to the axle in order to pour water out of the vessel and into the chamber (or if there is no chamber into a sink below). A water inlet is configured to deliver water to or into the vessel, for example by entering the vessel through a wall of the vessel, for example through the axle, or up to a valve. In certain embodiments, the vessel also has a valve mechanism including a valve connected to the water inlet. The valve mechanism is configured to close the valve and thereby block further entry of the water into the vessel whenever the water level in the vessel reaches a certain level. The term "valve" used in this patent application is a broad term that includes any kind of valve whatsoever that is configured to regulate water flow so as to block water flow in at least one mode and to allow water flow in at least one mode. The valve mechanism can comprise a float mechanism that includes a float that triggers a closing of the valve.

In certain embodiments, the water flow into a vessel is normally is a state of being "On"—that is, the water is constantly flowing into a vessel or at least towards the vessel up to a valve or a blockage point where it is blocked. The water inlet is configured to allow a constant flow of water into the vessel until the valve is closed by the float mechanism. When water is poured out of the vessel for washing and the water level in the vessel recedes, water flow into the vessel resumes and this happens automatically without the user (for example the person washing their hands) having to take any action.

The term "chamber" is a broad term that includes any container configured to hold water and can be made of any shape or material.

The principles and operation of an Assembly for Washing Vessel and Chamber may be better understood with reference to the drawings and the accompanying description.

As shown in FIGS. 1-16, in one embodiment, an apparatus 10 for washing hands comprises a chamber 20 configured to hold water for washing hands. Chamber 20 is configured with a water outlet 22 to drain the water out of chamber 20. The water that drains out is typically water poured from vessel 30. Typically, although not necessarily, water outlet 22 comprises one or more openings or holes in a floor of chamber 20 as can be seen from the bottom view of chamber 20 depicted in FIG. 5.

Apparatus 10 includes a vessel 30 inside chamber 20 configured to hold water and to pour water out when tilted (vessel is in chamber 20 in embodiments in which apparatus 10 includes a chamber 20). In one non-limiting version shown in FIGS. 1-5, chamber 20 has a ceiling 28 and vessel 30 is wholly contained within chamber 20. In general, at least a portion of the vessel 30 is situated in chamber 20 and typically most of vessel 30 is situated in chamber 20. In certain embodiments, more than 50% of vessel (as measured along the height of vessel 30) is situated in chamber 20, and, in other embodiments, more than 75% of vessel 30 is within chamber 20. In still other embodiments, more than 90% of vessel 30 is located within chamber 20 (including the space between the walls of chamber 20).

Vessel 30 may be any vessel suitable for holding water. Vessel 30 in certain embodiments is configured for convenient pouring water in vessel 30 out of vessel 30 onto a hand near vessel 30 by tilting vessel 30. In one embodiment depicted most easily seen in FIG. 2, vessel 30 is substantially conical in order to make it comfortable to a user to grasp a side of vessel 30 so as to tilt vessel 30, although this shape is not a requirement and vessel 30 can be shaped like an hourglass, cylindrical, substantially cylindrical or a mixture of shapes or any other shape or mixture of shapes. Vessel 30 may have a large open top. Vessel 30 in certain embodiments has no spout, although in other embodiments, vessel 30 can have a spout.

Apparatus 10 may also include an axle 40 that extends into chamber 20 and to vessel 30 or to a bearing assembly 70 connected to vessel 30. For example, axle 40 may extend from a wall of the room that apparatus 10 is located in or may extend from behind that wall or, in cases where water inlet 50 is within axle 40, from general water piping. Axle 40 is configured to attach to vessel 30 such that vessel 30 can rotate relative to axle 40. For example, vessel 30 may rotate using bearing assembly 70 attached to axle 40 and thereby allow the user to pour water out of vessel 30 onto the user's hands. The water poured from vessel 30 typically falls into chamber 20 and typically reaches the floor of chamber 20 containing a water outlet 22 (as a result of the user pouring water from vessel 30 onto the user's hands). Axle 40 is depicted as cylindrical in the drawings, although this is not a requirement.

As seen from FIG. 6B, FIG. 6C, FIG. 11, FIG. 12 and FIGS. 13A-13C, apparatus 10 may also include a water inlet 50 configured to bring water to or into vessel 30 for example by extending through vessel 30 for example by extending through a wall 31 of vessel 30. Typically, although not necessarily, water inlet 50 is located within axle 40 and runs through axle 40. Water inlet 50, in some embodiments, is defined by the inner walls of a hollow axle 40. In that case, the hollow space inside axle 40 is a water inlet 50. In other embodiments, water inlet 50 comprises a separate connector (for example a tube or pipe) within the hollow of axle 40 or is a separate connector (for example a tube or pipe) external to axle 40, for example alongside an outer wall of axle 40.

Water inlet 50 may bring water up to valve 65 in some embodiments. Valve 65 may be situated inside vessel 30 or may be situated at wall 31 of vessel 30 or may be situated outside vessel 30. In FIG. 6C, water inlet 50 penetrates wall 31 of vessel 30 at at least one point. However, this is not a requirement and water inlet 50 could be configured to move into vessel 30 from above vessel 30 through an open top or even through a closed lid (not shown) of vessel 30.

Axle 40 may be connected at a distal end of axle 40 to a wall of a room or building in which apparatus 10 is located or to water piping that extends beyond the wall of the room or building to a water source or to a main water pipe or hub.

In certain embodiments of apparatus 10, there is a mechanism 60, for example a valve mechanism 60, for regulating the flow of water into vessel 30 such that whenever the water level within vessel 30 reaches a certain height or a certain level, the valve mechanism automatically ensures that water stops flowing into vessel 30. Valve mechanism 60 may include valve 65 connected to water inlet 50. Valve mechanism 60 is typically in vessel or on vessel 30 but in some embodiments portions of valve mechanism 60 can be external to vessel 30.

In one implementation of valve mechanism 60, a sensor (not shown) along wall 31 of vessel 30 senses a height of the water level in the vessel 30 and triggers a closing of valve 65. A variety of other implementations of valve mechanism 60 are also contemplated. Closing of valve 65 may be triggered by water in vessel 30 reaching a certain level and this can be a level necessary to mechanically urge valve to close or this can be a predetermined height of the water in vessel 30, such as a certain percentage of the vessel 30 being full of water, or the trigger can be a height level of the water in vessel 30 or any of a variety of other triggers depending on the embodiment.

In one implementation of valve mechanism 60, vessel 30 comprises a float mechanism that includes a valve 65 and a float 62, the float 62 in certain embodiments situated within vessel 30, and the valve mechanism 60 is configured to close valve 65 when water in vessel 30 exerts an upward force on float 62. Float 62 is connected to valve 65, for example mechanically as shown in FIG. 6C and FIGS. 11-13C. As shown in FIG. 6C, in one non-limiting example, a top of float mechanism 60 may extend upward out of vessel 30, for example into bearing mechanism 70.

Figure 6B:
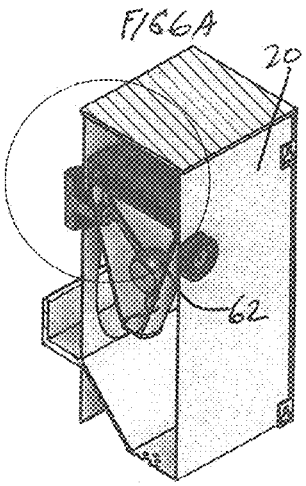
FIG. 6B is a partial sectional view showing an inside of a chamber used in an apparatus, in accordance with one embodiment.
Figure 6B:
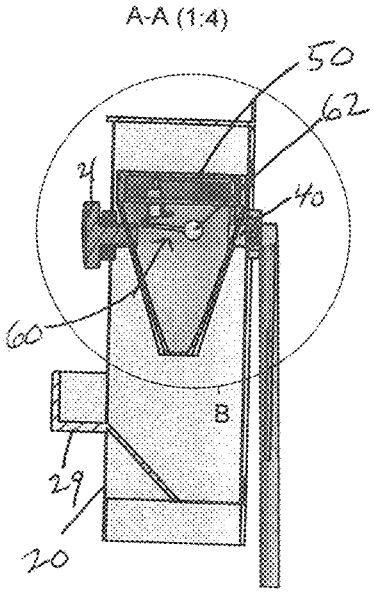
Figure 6C:
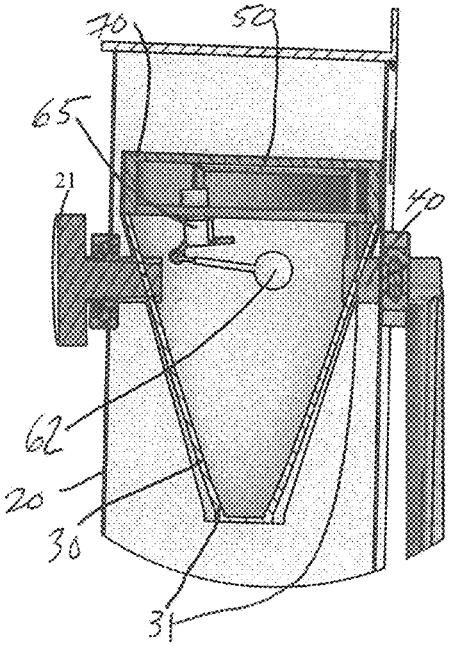
FIG. 6C is an enlarged view of certain portions of FIG. 6B.
Figure 6D:
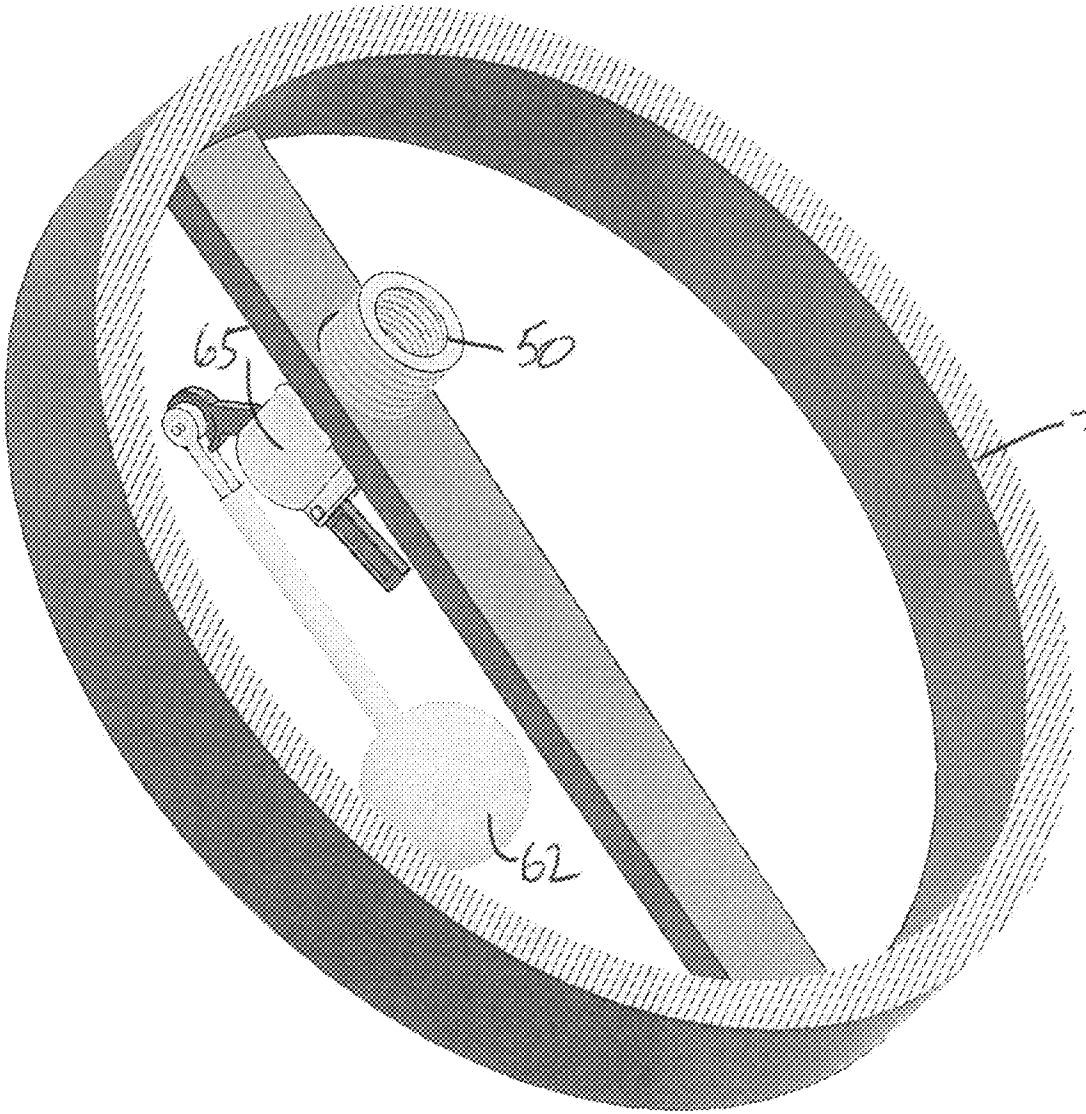
FIG. 6D is a perspective view from the top of portions of a bearing mechanism, water inlet and valve mechanism used in an apparatus, in accordance with one embodiment.
Figure 13C:
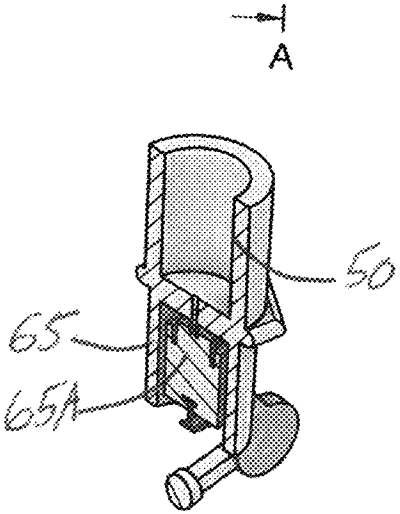
FIG. 13C is a sectional view from an angle of part of the valve mechanism and part of the water inlet used in an apparatus, in accordance with one embodiment.
Figure 15:
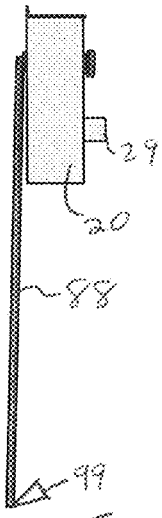
FIG. 15 is a side view of a chamber having a leg actuator used in an apparatus, in accordance with one embodiment.

One non-limiting configuration of float mechanism 60 is shown in detail in FIG. 11, FIG. 12 and FIGS. 13A-C and is also depicted in FIGS. 6A-6C. Water inlet 50 connects between axle 40 and valve 65 and as shown in FIG. 6B-6C water inlet may be situated with bearing assembly 70. In this configuration, float mechanism 60 is configured to close off the flow of water from water inlet 50 at valve 65 (FIGS. 6B-6C), for example at a point 55 (FIG. 13A-13B) where water inlet 50 meets valve 65. In FIGS. 13A-13B, the direction of the water flow is from the top to the bottom of the figure. Water travels in water inlet 50 and into valve 65. Valve 65 regulates the flow of water and thereby blocks further entry of the water flowing through water inlet 50 into vessel 30 under certain circumstances, for example when a water level in vessel 30 reaches a certain level, for example, when the water level in vessel 30 reaches a float 62 and typically when such water level exerts an upward force on float 62. Float 62 is normally stationary until the water in vessel 30 makes contact with float 62. Point 55 can be considered a choke point.

In one non-limiting embodiment, float 62 is connected mechanically to valve 65 such that the upward force of float 62 urges a component such as valve 65 to regulate the flow of water through valve 65. In one non-limiting example shown in FIGS. 11-13C and FIGS. 6A-6C, the upward force on float 62 may urge at least a component of float mechanism 60 such as one of a plurality of jointed levers 64*a*, 64*b* shown in FIG. 11 and FIG. 12 to move plug 65A (FIGS. 13A-13C) of valve 65 upwardly to plug the small opening at point 55 of water inlet 50 and thereby close valve 65. The sectional view of valve 65 in FIG. 17 shows plug 65A within valve 65.

In one particular non-limiting example of how this can be implemented, one of the jointed levers 64*a*, 64*b* shown in FIG. 11 may itself or through another element move so as to urge plug 65A to plug the opening 55 at the top of valve 65 that normally allows water to pass from water inlet 50. In this particular non-limiting example, when valve 65 is open, this opening at point 55 allows the flow of water through water inlet 50 and into vessel 30. In the event float 62 moves so as to urge a lever 64*a* or another component to close valve 65, plug 65A closes that opening 55. In general, when valve 65 closes, water flow through water inlet 50 into vessel 30 is blocked and stops. Other known configurations of levers may be used.

In other embodiments, valve 65 can instead be regulated and closed to block water flow in any of a number of other mechanical ways. In still other embodiments, valve 65 can be regulated from open to closed state using non-mechanical means such as electrical, electromagnetic and/using sensors.

Thus, the height of water level in vessel 30 is regulated so as to not exceed a certain height within vessel 30. That height is pre-determined, for example by the position of float 62 relative to the floor of vessel 30 to provide enough water to be available in vessel 30 with which to wash one's hand at least once and in some embodiments enough water to wash both hands once or at least once and in some embodiments enough water to wash both hands twice or at least twice or enough to wash both hands three times (in accordance with requirements of certain religious rituals which may require washing each hand twice or three times). For example, in certain embodiments, the float mechanism 60 is configured to ensure that water fills vessel 30 until vessel 30 is at least half full or in other embodiments is two-thirds full or in other embodiments is three-quarters full or in other embodiments is at least 80% or at least 90% full or is completely full. In certain embodiments, the float mechanism 60 is configured to ensure that water fills vessel 30 until vessel 30 holds 250 cc or a particular amount that is at least 250 cc or in other embodiments holds 500 cc or a particular amount that is at least 500 cc or in other embodiments holds 750 cc or a particular amount that is at least 750 cc or in other embodiments holds a liter or a particular amount that is at least a liter or in other embodiments holds a liter and a half or a particular amount that is at least a liter and a half. Other amounts are possible and these are non-limiting examples.

Normally, water inlet 50 is configured to allow a constant flow of water into vessel 30 until water inlet 30 is closed by float mechanism 60. In other words, the flow of water is "on" all the time and is just blocked when the water level in vessel 30 reaches a certain level. This means that each person in the typically long line of people lining up to wash their hands does not teach first turn on the water (and later turn off the water so the sink does not overflow) and does not even need to position a washing vessel underneath a faucet. In addition, the apparatus 10 is configured to ensure that an entire washing station is in place and ready for use by large numbers of people whenever necessary. In embodiments where apparatus 10 is attached to the wall, the washing vessel does not have to be guarded to make sure it is not lost or taken away by a child for example. In many wedding halls and restaurants, the washing vessel is tied to the sink area by a chain whereas apparatus 10 alleviates the need for this.

Figure 3:
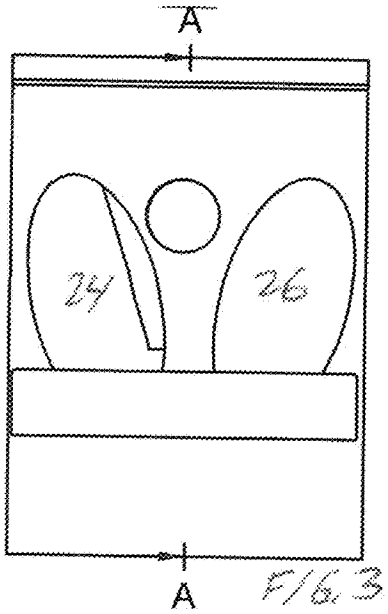
FIG. 3 is a front view of the chamber of FIG. 1, in accordance with one embodiment.

As seen from FIG. 1 and FIG. 3, chamber 20 may have at least one wall 25, for example a front wall that has two apertures 24, 26. Each aperture 24, 26 is configured to be large enough for an individual to insert a hand into chamber 20 far enough to reach and manipulate vessel 30 such as by tilting. Typically, apertures 24, 26 are large enough for people with very large hands to insert their hands and large enough to provide some extra room to spare for comfortable movement of the hands once inserted. The openings 24, 26 are configured such that once the user's hands are inserted, the user's hands can grab a side of vessel 30 to tilt vessel 30 to the right or to the left since vessel 30 is rotatable relative to axle 40. In this way, the user can quickly and conveniently wash their hands using a washing vessel. In one non-limiting embodiment, the width of each aperture 24, 26 (along an axis parallel to a floor of chamber 20) is between four and eight inches. In one non-limiting embodiment, the height of each aperture 24, 26 (along an axis perpendicular to the floor of chamber 20) is larger than its width.

Figure 7:
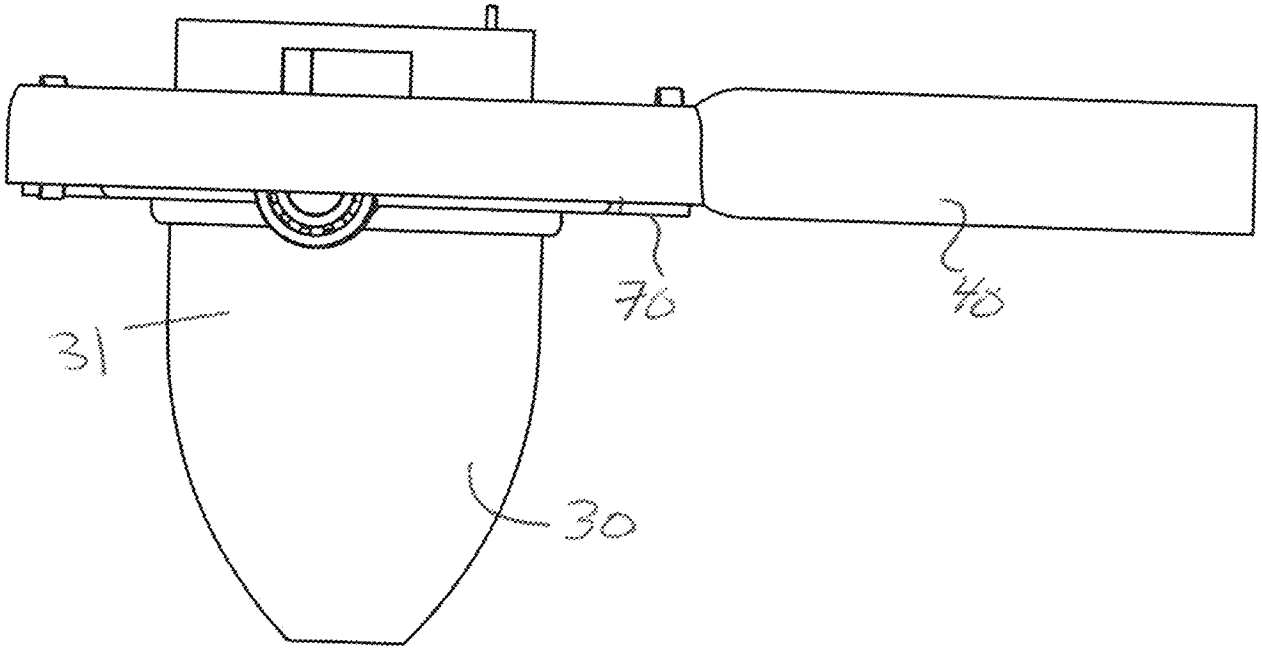
FIG. 7 is a side view of a washing apparatus not showing a chamber, in accordance with one embodiment.
Figure 8:
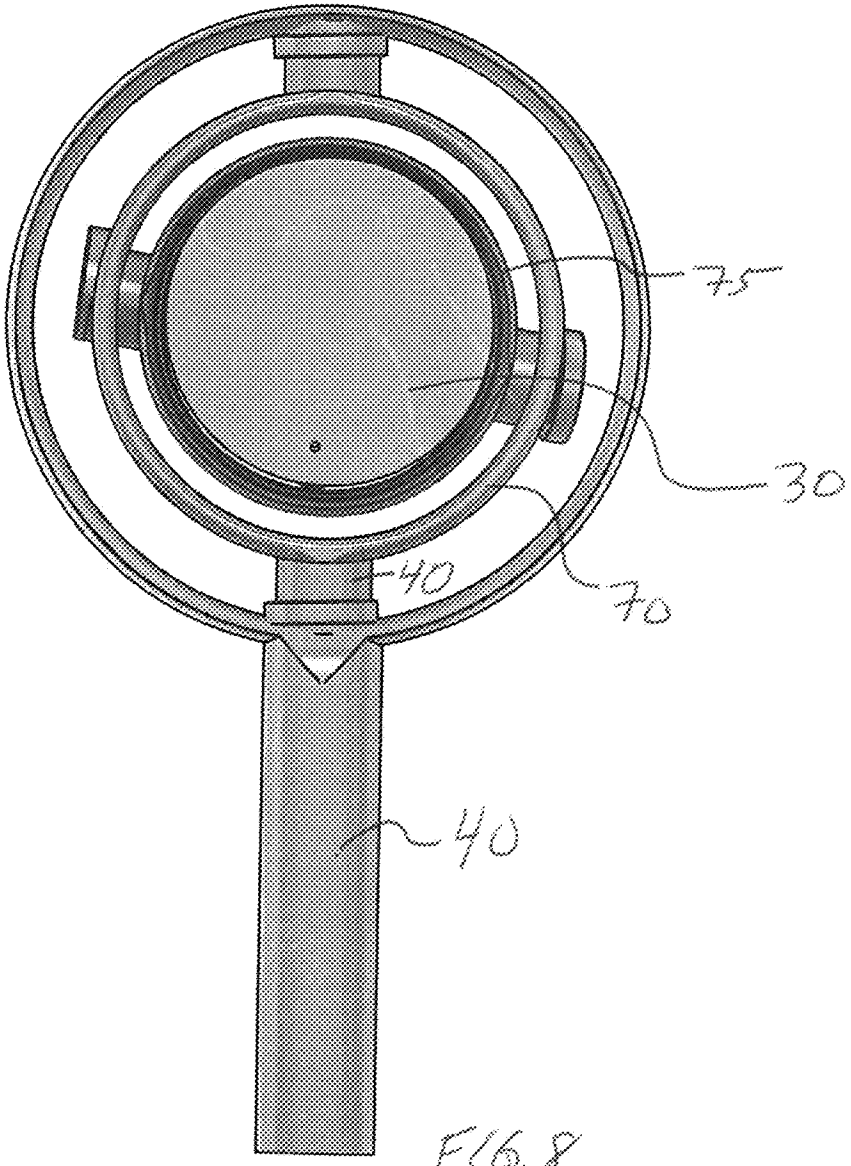
FIG. 8 is a top view of a washing apparatus having two bearings, in accordance with one embodiment.
Figure 9:
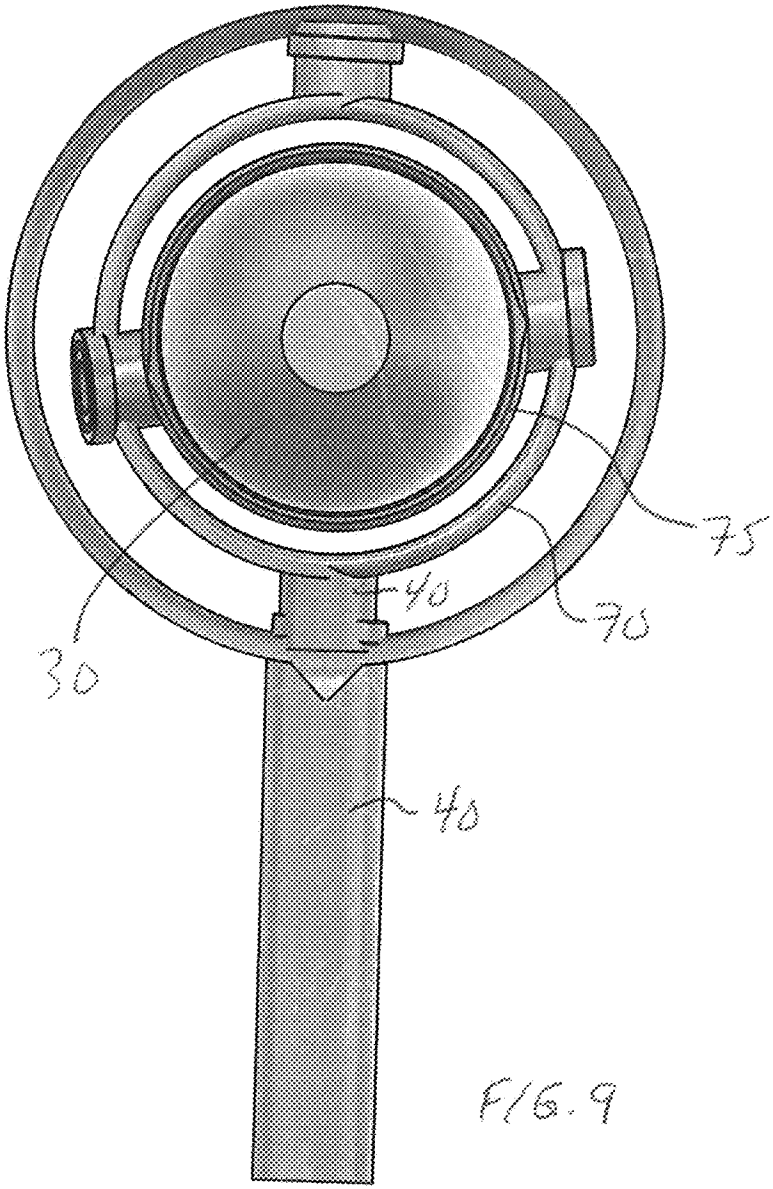
FIG. 9 is a bottom view of the apparatus of FIG. 8, in accordance with one embodiment.
Figure 10:
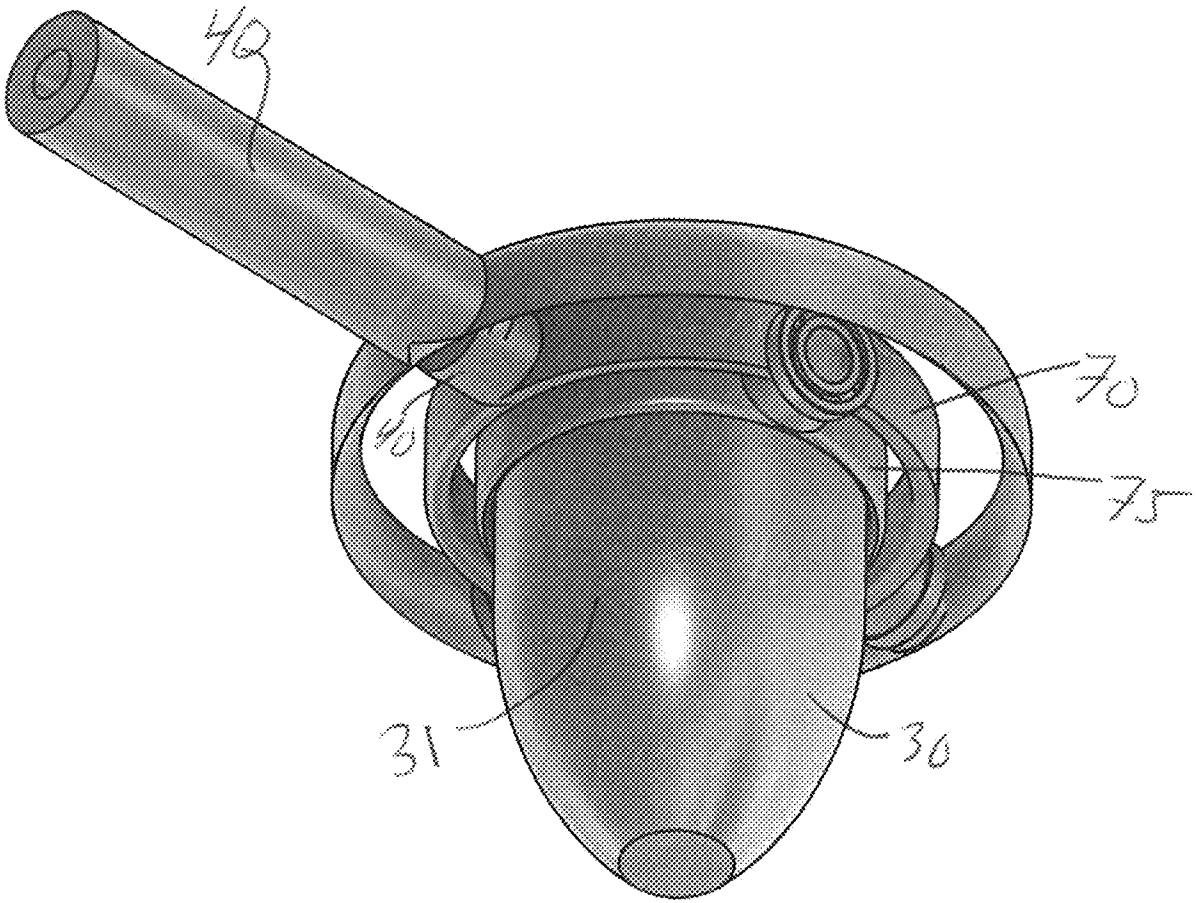
FIG. 10 is a perspective view of the apparatus of FIG. 8, in accordance with one embodiment.

As shown in FIG. 8, FIG. 9 and FIG. 10, the rotation of vessel 30 may be implemented using a bearing assembly 70 that is attached to a proximal end (the end visible in FIGS. 7-10) of axle 40. Water inlet 50 leaves axle 40 and reaches bearing assembly 70 as shown in FIG. 8 and as shown in FIG. 6C continues into valve 65 and vessel 30. In one non-limiting embodiment shown in FIGS. 8-10, a second bearing assembly 75 allows a further rotation of vessel 30 in a direction perpendicular to the left-right rotation (relative to the user) so as to provide two degrees of freedom (a first degree of freedom provided by first bearing assembly 70 for rotating left-right relative to axle 40 and a second degree of freedom provided by second bearing assembly 75 for rotating forward and back). That is, vessel 30 may also be rotated forward and backward (relative to the user) using second bearing assembly 75. In certain embodiments, there is only one bearing assembly 70 and vessel 30 (for example together with its first bearing assembly 70) is rotated (from the point of view of the user washing their hands) relative to axle 40 to the left and to the right by tilting vessel 30 to the left and to the right. Each of the bearing assemblies 70, 75 may include at least one bearing (or a set of bearings) and a metal connector such as a ring connecting the at least one bearing to vessel 30.

Figure 2:
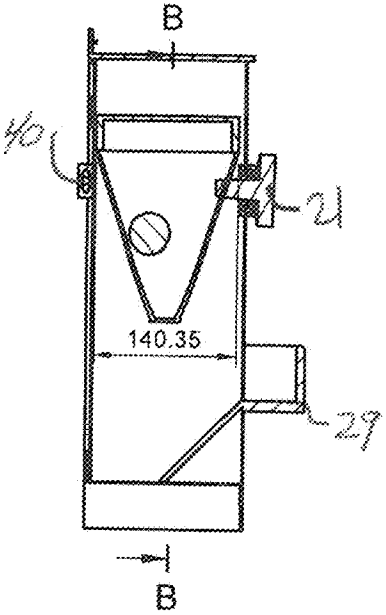
FIG. 2 is a sectional view of the chamber of FIG. 1, in accordance with one embodiment.

As seen from FIG. 1 and FIG. 2, a front wall 27 of chamber 20 may have a ledge 29 extending forward toward the user. Ledge 29 is configured to catch drops of water that are thrown or sprayed outwardly during the washing process.

In accordance with certain embodiments, apparatus 10 may have an actuator 21 facing outward from outer wall of chamber 20 with which to cause vessel 30 to tilt for washing. This can be useful when a parent is assisting a child in washing hands or for people with certain handicaps. The child sticks their hands into apertures 24, 26 and the parent activates, for example turns, the actuator 21. In one non-limiting implementation of this, actuator 21 comprises a handle 21 configured to jut out of chamber 20 for rotating vessel 30 relative to axle 40 from outside chamber 20. In one example, the handle 21 is a simple knob 21 that can be turned in either direction to tilt vessel 30 left or right. Other ways of actuating the tilting of vessel 30 are also possible. Another way in which tilting vessel 30 can be actuated is by a leg-actuated lever 99 configured to rotate vessel 30 as shown schematically in FIG. 15. The leg-actuated lever or pedal 99 is connected by a thin connector 88 to vessel 30, in one non-limiting embodiment such that actuation and/or movement by one's leg or foot of pedal 99 in one or more positions actuates tilting of vessel 30 (in certain embodiments using mechanical or other connectors or components within chamber 20 (not shown)) to the right and/or to the left.

In certain embodiments, chamber 20 has a ceiling, for example a rotatable ceiling 28 (FIG. 1), and chamber 20 is configured to attach to a wall of a room such that the ceiling 28 cannot be rotated (and chamber 20 therefore cannot be opened) as long as chamber 20 is attached to the wall of the room. This is to prevent tampering by users with the contents of chamber 20.

Chamber 20 may be situated against a wall of a room or even behind the wall. In either case, the user sticks his or her hands into the apertures 24, 26 of chamber 20 to wash their hands.

Figure 4:
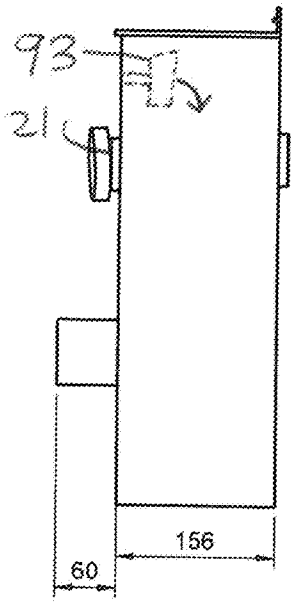
FIG. 4 is a side view of the chamber of FIG. 1, in accordance with one embodiment.
Figure 5:
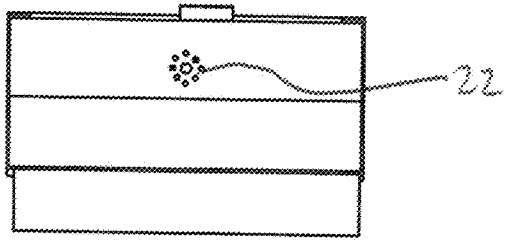
FIG. 5 is a bottom view of the chamber of FIG. 1, in accordance with one embodiment.

In certain embodiments, for example in accordance with one non-limiting implementation shown in dotted lines in FIG. 4, apparatus 10 includes an automated drying machine 93 configured to blow hot air on the hands alongside (i.e. alongside vertically or horizontally so as to be above or on the side of) chamber 20 (or in other embodiments chamber 20 is larger and the drying machine is inside chamber 20). In one version, the hand drying mechanism (FIG. 4) includes a fan or air blowing mechanism configured to blow air on a user's hands (see arrow in FIG. 4) while the user's hands are situated at least partly in the apertures 24, 26. In one implementation of this, the act of the user inserting his or her hands or the action of the vessel 30 tilting activates a sensor or a timer (not shown) to trigger the blowing of the fan to dry the user's hands a certain number of seconds (for example 5 seconds or 10 seconds or 15 seconds or a number between 5 and 15 seconds) in the future.

One embodiment of apparatus 10 does not include any chamber 20. FIG. 7 depicts a vessel 30, axle 40 and bearing assembly 70 used in an apparatus 10 without a chamber 20 but FIG. 7 can also be for an apparatus 10 that includes a chamber 20 though chamber 20 is not shown therein. In one non-limiting implementation, apparatus 10 without chamber is identical to any suitable version of apparatus 10 that includes chamber 20 except without chamber 20 and except that axle 40 does not attach to a chamber 20 but instead extends to vessel 30 or to a bearing assembly attached to vessel 30.

In the embodiment of apparatus 10 that does not include any chamber 20, instead of chamber 20, the apparatus 10, and in particular axle 40 of apparatus 10, attaches to any infrastructure such as a wall having a sink in front of it. In that case, the water that pours out of vessel 30 falls into the sink (external to apparatus 10) instead of into a chamber 20 of apparatus 10 after the user washes his or her hands. Accordingly, in this embodiment, apparatus 10 for washing hands, comprises vessel 30 for holding and pouring water, axle 40 configured to attach to vessel 30 such that vessel 30 is configured to rotate relative to axle 40 to pour water out of vessel 30 and into a drainage area external to the apparatus 10, a water inlet 50 configured to deliver water to or into the vessel 30. Vessel has a mechanism 60 such as a valve mechanism for regulating a flow of water into vessel 30 such that whenever a water level in vessel 30 reaches a certain level, the valve mechanism 60 automatically ensures that water stops flowing into vessel 30. Valve mechanism 60 may include a valve 65 connected to water inlet 50. Water inlet 50 is configured to allow a constant flow of water into vessel 30 until water inlet 50 is closed by valve mechanism 60.

In one implementation, axle 40 is configured to attach on one of its ends to infrastructure such as a wall external to apparatus 10, the axle 40 also configured to attach on the other (proximal) end to vessel 30 such that vessel 30 is configured to rotate relative to the axle 40 (for example using bearing assembly 70 connected to axle 40) in order to pour water out of vessel 30 (and into a sink or other suitable drainage area external to apparatus 10, for example below vessel 30). Apparatus includes a water inlet 50 configured to extend into vessel 30 through a wall 31 of vessel 30. Water inlet 50 may comprise a tube or pipe inside axle 40 or may be situated external to axle 40. Instead of a separate tube or pipe inside axle 40, water inlet 50 may just comprise the inner space defined by the inner walls of axle 40. Vessel 30 may also comprise a valve mechanism 60 configured to regulate flow of water through water inlet 50, for example using valve 65, and thereby block further entry of the water into vessel 30 when a water level in vessel 30 reaches a certain level. For example, valve mechanism 60 may comprise a valve 65 and a float 62. Water inlet 50 is configured to allow a constant flow of water into vessel 30 until the water inlet is closed by the float mechanism 60.

In the embodiment where there is no chamber 20, apparatus 10 may comprise any suitable version of its components (including but not limited to any suitable version of any portion of vessel 30, axle 40 water inlet 50, mechanism 60 or valve mechanism 60) described in relation to the embodiment of apparatus 10 that does include chamber 20. For example, apparatus 10 may include an actuator 21 such as a handle extending outwardly from vessel 30, for example from a front of vessel 40, that allows a user to rotate vessel 30 relative to axle 40 without having to contact vessel 30 directly. In another example, apparatus 10 may include a clamp assembly configured to attach apparatus (without a chamber) to a desk (for example by attaching to axle 40). In another example, apparatus 10 includes the hand drying mechanism which for example is attached to axle 40 or to a nearby wall or other infrastructure.

Figure 14:
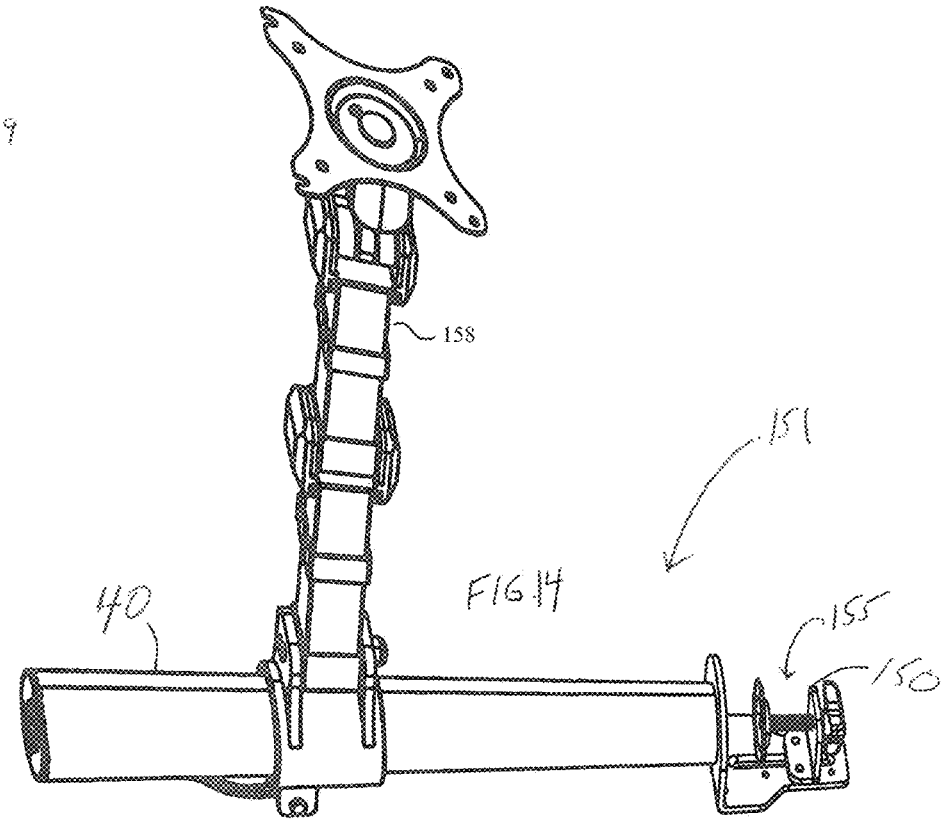
FIG. 14 is a front view of a clamp assembly used in an apparatus, in accordance with one embodiment.

In some variations, apparatus 10 is configured to be attached to a desk using a clamp assembly. As shown in FIG. 14, in one non-limiting example, apparatus 10 includes a clamp assembly 151 for attaching apparatus 10 to a desk. One non-limiting embodiment of the clamp assembly includes a clamp 150 having a variable space 155 whose length is governed by a controlling component such as a screw mechanism. The clamp 150 may be configured to clamp onto a side of a desk so as to attach apparatus 10 to a desk. In one non-limiting implementation, clamp 150 is connected in turn to a rod 40 that is the same as axle 40. Rod/axle 40 may be connected to chamber 20 and/or to a bearing assembly 70 of vessel 30 (not shown in FIG. 14). Rod 40 may have a water inlet tube 50 that is inside or external to rod 40 and is connected to a water source such as a water pipe or a sink. This makes apparatus 10 portable. In FIG. 14, the washing vessel 20 would be attached to infrastructure to the left of rod 40. Rod 157 may also be connected to arm 158 for additional attachments.

For embodiments in which apparatus 10 includes chamber 20, apparatus 10 may also be combined with the clamp assembly 151 shown in FIG. 14. For example, rod/axle 40 would extend into chamber 20 (not shown in FIG. 14 but would attached at the left of rod/axle 40) and would extend further to vessel 30 or to a bearing assembly 70 that is connected to vessel 30. For embodiments in which apparatus 10 does not include a chamber 20, apparatus 10 may also be combined with the clamp assembly 151 shown in FIG. 14.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. An apparatus for washing hands, comprising:

a chamber configured to hold water for washing hands, the chamber having a water outlet to drain the water out of the chamber, wherein at least one wall of the chamber has two apertures, each of the two apertures is configured to allow an individual to insert a hand into the chamber;

a vessel for holding and pouring water, at least a portion of the vessel situated in the chamber;

an axle extending into the chamber and configured to attach to the vessel such that the vessel is configured to rotate relative to the axle in order to pour water out of the vessel and into the chamber;

a water inlet configured to deliver water to or into the vessel, the vessel having a valve mechanism for regulating a flow of water into the vessel such that whenever a water level in the vessel reaches a certain level, the valve mechanism automatically ensures that water stops flowing into vessel, the valve mechanism including a valve connected to the water inlet, wherein the water inlet is configured to allow a constant flow of water into the vessel until the valve is closed by the valve mechanism.

2. The apparatus of claim 1, wherein the valve mechanism includes a float situated in the vessel and the valve mechanism is configured to close the valve when water in the vessel exerts an upward force on the float.

3. The apparatus of claim 1, wherein the water inlet runs through the axle.

4. The apparatus of claim 1, further comprising a vessel handle configured to extend outside the chamber for rotating the vessel on the axle from outside the chamber.

5. The apparatus of claim 1, wherein the chamber has a rotatable ceiling and is configured to attach to a wall of a room such that the ceiling cannot be rotated as long as the chamber is attached to the wall of the room.

6. The apparatus of claim 1, further comprising a clamp assembly for attaching the chamber to a desk.

7. The apparatus of claim 1, further comprising an automated hand drying mechanism situated in or alongside the chamber.

8. The apparatus of claim 1, further comprising an automated hand drying mechanism situated in or alongside the chamber, the automated hand drying mechanism including a fan configured to blow air on a user's hands when the user's hands are situated at least partly in the chamber having been inserted at least partially through the apertures.

9. The apparatus of claim 1, further comprising a leg-activated actuator for rotating the vessel.

10. The apparatus of claim 1, further comprising a first bearing assembly connecting the vessel to the axle, the first bearing assembly configured to allow rotation of the vessel relative to the axle with one particular degree of freedom of movement and a second bearing assembly configured to allow rotation of the vessel relative to the axle with a second degree of freedom.

11. The apparatus of claim 1, wherein the chamber includes a ledge jutting out of a front wall of the chamber.

12. An apparatus for washing hands, comprising:

a vessel for holding and pouring water;

an axle configured to attach to the vessel such that the vessel is configured to rotate relative to the axle in order to pour water out of the vessel and into a drainage area external to the apparatus;

a water inlet configured to deliver water to or into the vessel, the vessel having a valve mechanism for regulating a flow of water into the vessel such that whenever a water level in the vessel reaches a certain level, the valve mechanism automatically ensures that water stops flowing into vessel, the valve mechanism including a valve connected to the water inlet, wherein the water inlet is configured to allow a constant flow of water into the vessel until the valve mechanism is closed by the valve mechanism, wherein the apparatus further comprises a clamp assembly configured to attach the apparatus to a desk external to the apparatus in a manner that allows access by a user's hand to the vessel, the access allowing the user's hand to be washed when the vessel is rotated.

13. The apparatus of claim 12 wherein the valve mechanism includes a float situated in the vessel and the valve mechanism is configured to close the valve when water in the vessel exerts an upward force on the float.

14. The apparatus of claim 12, wherein the water inlet runs through the axle.

15. The apparatus of claim 12, further comprising a vessel handle configured to rotate the vessel relative to the axle.

16. The apparatus of claim 12, further comprising a leg-activated actuator for rotating the vessel.

17. The apparatus of claim 12, further comprising a first bearing assembly connecting the vessel to the axle, the first bearing assembly configured to allow rotation of the vessel relative to the axle with one particular degree of freedom of movement and a second bearing assembly configured to allow rotation of the vessel relative to the axle with a second degree of freedom.

18. The apparatus of claim 12, wherein the infrastructure is a wall and wherein the axle is configured to attach to the vessel at a first end of the axle and to the wall at a second end of the axle.

19. An apparatus for washing hands, comprising:

a chamber configured to hold water for washing hands, the chamber having a water outlet to drain the water out of the chamber, wherein at least one wall of the chamber has at least one aperture, each of the at least one aperture is configured to allow an individual to insert a hand into the chamber;

a vessel for holding and pouring water, at least a portion of the vessel situated in the chamber;

an axle extending into the chamber and configured to attach to the vessel such that the vessel is configured to rotate relative to the axle in order to pour water out of the vessel and into the chamber;

a water inlet configured to deliver water to or into the vessel, the vessel having a valve mechanism for regulating a flow of water into the vessel such that whenever a water level in the vessel reaches a certain level, the valve mechanism automatically ensures that water stops flowing into vessel, the valve mechanism including a valve connected to the water inlet, wherein the water inlet is configured to allow a constant flow of water into the vessel until the valve is closed by the valve mechanism, and wherein one of the following is true:

(i) the apparatus further comprises an automated hand drying mechanism situated in or alongside the chamber; or (ii) the chamber has a rotatable ceiling and is configured to attach to a wall of a room such that the ceiling cannot be rotated as long as the chamber is attached to the wall of the room.

* * * * *